US005121128A

United States Patent [19]

van Lidth de Jeude et al.

[11] Patent Number: 5,121,128

[45] Date of Patent: Jun. 9, 1992

[54] GLIDE-SLOPE AERIAL SYSTEM

[76] Inventors: Johan L. van Lidth de Jeude, Rhijnestein 2, 3945 BD Cothen; Dirk Wagner, Vincent van Goghstraat 11, 2162 CH Lisse, both of Netherlands

[21] Appl. No.: 487,209

[22] Filed: Mar. 1, 1990

[30] Foreign Application Priority Data

Mar. 17, 1989 [NL] Netherlands ..... 8900669

[51] Int. Cl.[5] ..... H01Q 1/48

[52] U.S. Cl. ..... 343/741; 343/705; 343/846

[58] Field of Search ..... 343/705, 741, 742, 846, 343/828

[56] References Cited

U.S. PATENT DOCUMENTS

| | | | |
|---|---|---|---|
| 3,808,600 | 4/1974 | Bourdnier | 343/847 |
| 3,906,507 | 9/1975 | Allen, Jr. | 343/705 |
| 3,984,838 | 10/1976 | Voronoff | 343/739 |
| 4,051,477 | 9/1977 | Murphy et al. | 343/846 |
| 4,217,591 | 8/1980 | Czerwinski | 343/713 |

OTHER PUBLICATIONS

The Microwave Journal, vol. 11, No. 7, Jul. 1968, p. 98E.

*Primary Examiner*—Michael C. Wimer

*Attorney, Agent, or Firm*—Handal & Morofsky

[57] ABSTRACT

Glide-slope aerial system intended to function in a relatively restricted space, for example the radome space of an aircraft, comprising one or more half-loop aerials which are supported by the electrically conducting ground plane of the radome space. Each aerial (10) is mounted on a separate base plate (11) whose dimensions are chosen in a manner such that the base plate is resonant at the frequency at which the respective aerial operates. The base plate is positioned in the radome space in a manner such that the base plate extends at least essentially parallel to the ground plane (14), the distance between the base plate and the ground plane being approximately equal to or less ¼ of the wavelength at which the respective aerial functions.

4 Claims, 3 Drawing Sheets

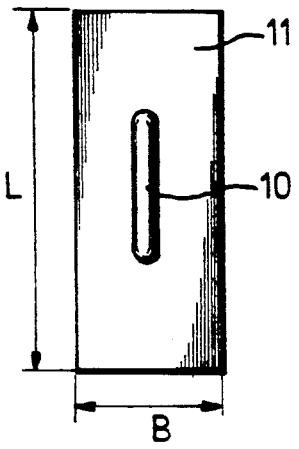
FIGURE 3(A)
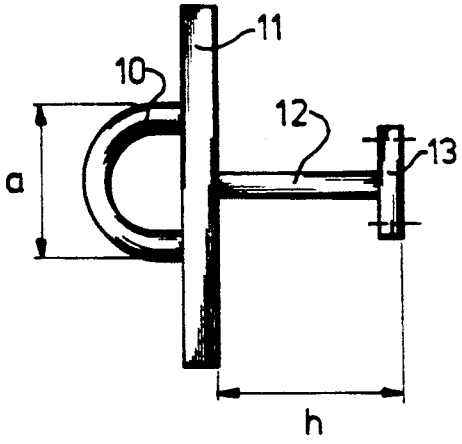
FIGURE 3(B)
Fig-4
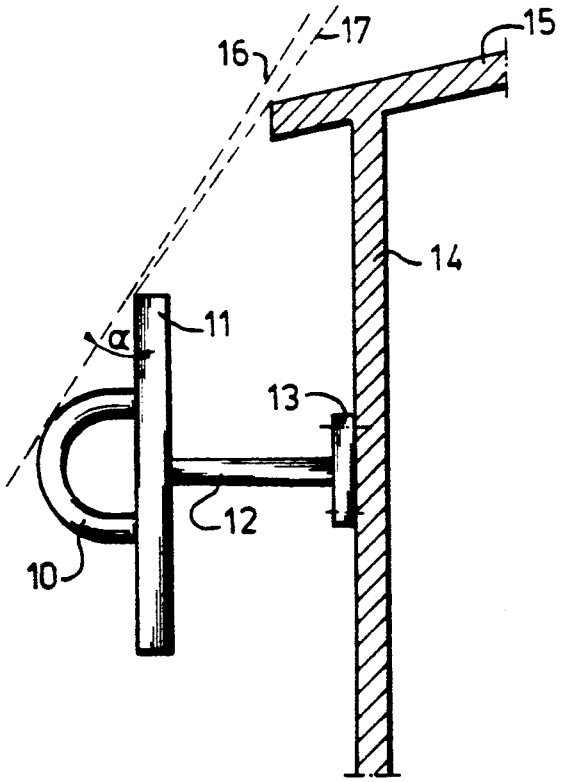

GLIDE-SLOPE AERIAL SYSTEM

TECHNICAL FIELD

The invention relates to a glide-slope aerial system intended to function in a relatively restricted space, especially the radome space of an aircraft, comprising one or more half-loop aerials which are supported by the electrically conducting ground plane of the said space.

BACKGROUND OF THE INVENTION

Glide-slope aerials or angle-of-approach aerials are generally used in combination with localizer aerials or directional aerials in an automatic landing system in aircraft. Transmitters at the beginning and the end of the landing path transmit signal beams which are received by the aerials. If the aircraft deviates from a predetermined approach course, this will be indicated by a difference in intensity in the signals received.

Glide-slope aerials are known per se from the prior art, for example from the U.S. Pat. Nos. 3,906,507 and 3,220,006. If used in an aircraft, such glide-slope aerials are generally sited in the radome space in the nose of the aircraft, which radome space is bounded at one side by a vertical surface which is perpendicular to the longitudinal axis of the aircraft. It is possible for this surface to be the front pressure bulkhead of the passenger cabin.

Glide-slope aerials are horizontally polarized, semicircular, arc-type or half-loop aerials. In other words, glide-slope aerials may be regarded as magnetic dipoles whose dipole axis is vertically directed and extends in a vertical plane through the base points of the aerial.

In principle, such a semicircular arc-type aerial sited, on an infinitely large ground plane has an omni-directional pattern in the forward direction and no depolarization component. Because the bulkhead which has to serve as ground plane for use in an aircraft is not infinitely large, but has, for example, a diameter of only 1.5 $\cong$ (=1.5 wavelengths) the currents which are induced in the ground plane as a consequence of the electromagnetic radiation generated by the aerial will be deflected at the edge of the ground plane, which produces a relatively strong component in the direction of the said edge. If the aerial is in the centre of the ground plane (which is assumed for the sake of convenience to simply be symmetrical), the resulting depolarization component formed by the resulting vertical component of the edge currents would be balanced in the principal planes of symmetry, as a result of which the radiation pattern will not have any depolarization component in those directions. For other directions, however, a small component of, for example, −20 dB will be left over.

However, if one sites the aerial not in the centre of the ground plane, but if the aerial is for example pushed upwards, the current is no longer symmetrically deflected at the edge, and as a result of this the vertical components of current are no longer balanced and a depolarization component is produced in the radiation pattern even in directions situated in the principal plane of symmetry. The nearer the aerial comes to the edge of the ground plane, the stronger the effect becomes. Especially when the distance from the edge of the ground plane becomes less than 1/6 λ, the reactive currents around the base of the aerial are also affected. Since there is generally very little space in the radome space of an aircraft and an increasing number of aerials (for radar purposes, automatic landing systems etc.) have to be installed in the radome space, it will generally not be possible to mount the glide-slope aerial in the centre of the ground plane. In practice, however, distances from the edge of less than 1/6 λ do not occur.

If two or more aerials are sited within each other's sphere of influence on the ground plane, coupling currents will start to run across the ground plane. In general, this situation will occur in practice. The coupling currents which occur affect the radiation pattern of both aerials and have, in addition, vertical components in the case where the aerials are not at the same height. Any inclination of the ground plane, the presence of stiffeners situated on the outside of the ground plane and high edges of the radome space also give rise to deformation of the radiation pattern and additional depolarization.

The effect of the stiffening components can be eliminated by fitting a flat plate in the radome space in front of the irregular structure of the stiffeners, on which plate the glide-slope aerials can be mounted. The above-mentioned effects due to the (high) edge boundary of the radome space and any inclination of the pressure bulkhead are not, ,however, eliminated thereby.

SUMMARY OF THE INVENTION

The object of the invention is therefore to provide measures, by means of which the glide-slope aerial system acquires electromagnetic characteristics such that a) the disadvantageous effect which the local, rearwardly situated structure of the ground plane may have on the radiation pattern and on the depolarization is considerably reduced, and b) the mutual coupling between the glide-slope aerials tuned to the same frequency band is reduced.

This object is achieved in a glide-slope aerial system of the type mentioned in the introduction in that each aerial is mounted on a separate base plate whose dimensions are chosen in a manner such that the base plate is resonant at the frequency at which the respective aerial operates, which base plate is positioned in the said space in a manner such that the base plate, extends at least essentially parallel to the said ground plane and is supported in its center, the distance between the base plate and the ground plane being approximately equal to or less than $\frac{1}{4}$ of the wavelength at which the respective aerial functions.

The base plate to be used should be as small as possible in view of the restricted available space and should furthermore be electrically neutral, that is to say, the radiation pattern of the aerial mounted on the base plate is affected as little as possible and the radiation impedance of the aerial remains the same. This electrical neutrality is achieved by choosing the dimensions and the shape of the base plate in a manner such that the current distribution thereon is inherently kept in balance by the surrounding reactive field, while, in addition, the current does not need to seek an outlet along the rear side of the base plate, via the mounting means with which the base plate is mounted on the ground plane. In other words, the base plate has to be resonant so that in a natural way the value of the current vector is zero at those points where the current vector is perpendicular to the edge.

In the glide-slope aerial, whose radiation pattern has an asymmetrical nature in the plane of the base plate with maxima in the horizontal transverse directions viewed with respect to the aircraft and minima in the vertical direction, the principal current direction in the base plate is horizontal. In order to conform to the above stated requirement that the current distribution on the base plate is inherently kept in balance by the surrounding reactive field, the base plate must have a linear nature in the direction of said principal current. The length of the base plate therefore has to be approximately equal to $\frac{1}{2}\lambda$ or a multiple thereof and in view of the minimum desirable dimensions the length of the base plate has therefore preferably to be approximately $\frac{1}{2}\lambda$. The width of the plate (in the mounted position, the height of the plate) must be sufficient to allow the loop current to close at the aerial base. Said closing current runs approximately in a circular arc from the one leg of the circular arc-type aerial to the other leg. The width of the base plate must therefore be at least equal to the distance between the legs in order to provide an adequate continuous space for an uninterrupted path for said current and is in the present case one and a half to two times as large.

In the above it has furthermore been stated that the base plate has to be of a construction such that the current does not have any outlet along the rear side of the base plate to the underlying structure. In view of this, the base plate has to be sited at some distance from, parallel to and in front of the front ground plane, preferably in a manner such that the mounting operates centrally on the rear side of the base plate between the base plate and the pressure bulkhead. In this manner, the base plate forms together with the pressure bulkhead a centrally short-circuited Lecher line. If the ends thereof are at about $\frac{1}{4}\lambda$ from the short circuit, they have an infinitely high impedance with respect to the bulkhead, and as a result of this current drain to the bulkhead is prevented.

If more than one glide-slope aerial is sited on the bulkhead, each of which is provided with its own base plate, no coupling currents will flow via the ground plane, with the result that no depolarization component can be produced either, while the strong resonant current component on the base plate of each aerial is horizontally directed and therefore does not cause any depolarization.

BRIEF DESCRIPTION OF THE DRAWINGS

The invention will be explained below in more detail with reference to the accompanying figures:

FIGS. 3(*a*) and 3(*b*) show, in more detail, an embodiment of one of the aerial baseplate mounting structure combinations associated with the system from FIG. 2.

FIG. 4 illustrates diagrammatically the screening action of the baseplate and also illustrates the shadow angle $\alpha$.

DETAILED DESCRIPTION

Figure 1:
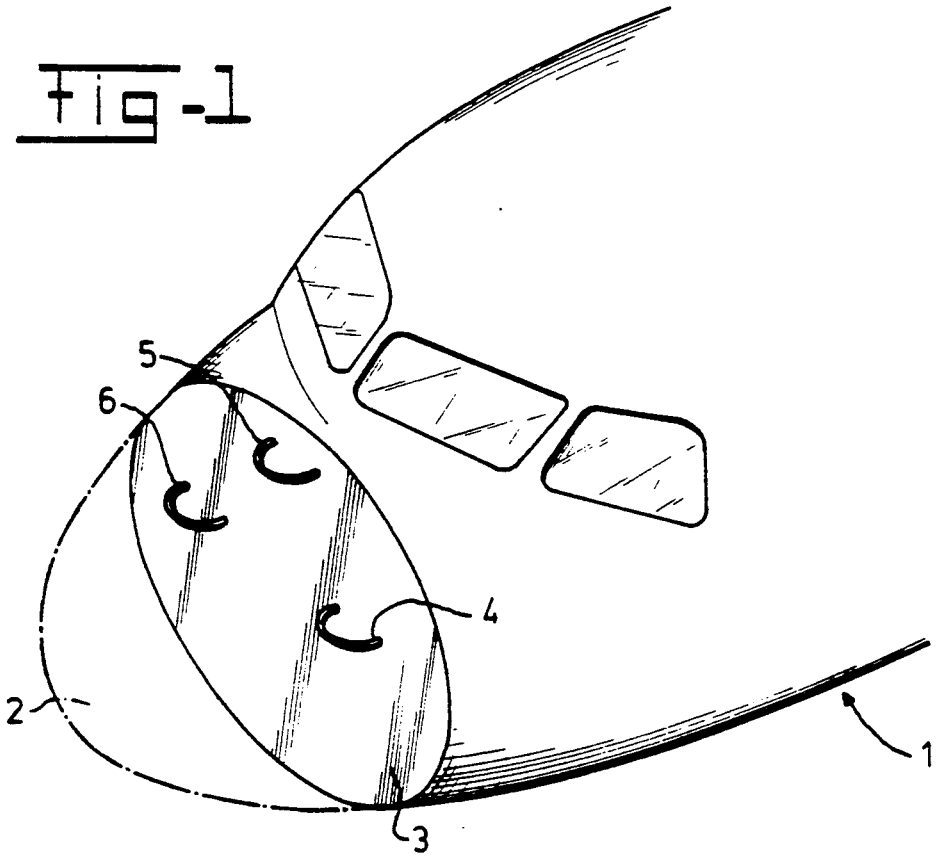
FIG. 1 shows diagrammatically t arrangement of three glide-slope aerials which are each sited directly on the same ground plane, in this case the front bulkhead of an aircraft. The aerials are shown diagrammatically by a semicircular arc, which they essentially also are.

FIG. 1 shows the nose section of an aircraft 1, the actual radome space being indicated only diagrammatically by 2 so that the front pressure bulkhead 3 becomes visible in the figure. Mounted on said pressure bulkhead 3 are three glide-slope aerials 4, 5 and 6. Said glide-slope aerials may, for example, be of the type described in the U.S. Pat. No. 3,220,006. Because said aerials 4, 5 and 6 are mounted directly against the pressure bulkhead 3, the disadvantages already indicated above are obtained.

FIG. 2 again shows the nose section of the aircraft 1, the radome space 2 again being shown by a broken line so that the front pressure bulkhead 3 becomes visible. Three glide-slope aerials, indicated by 7, 8 and 9, are mounted with the aid of spacer components at a predetermined distance from, and supported by, the pressure bulkhead 3. Each of said aerials 7, 8 and 9 is constructed in the manner illustrated in more detail in FIGS. 3(*a*) and 3(*b*).

Figure 2:
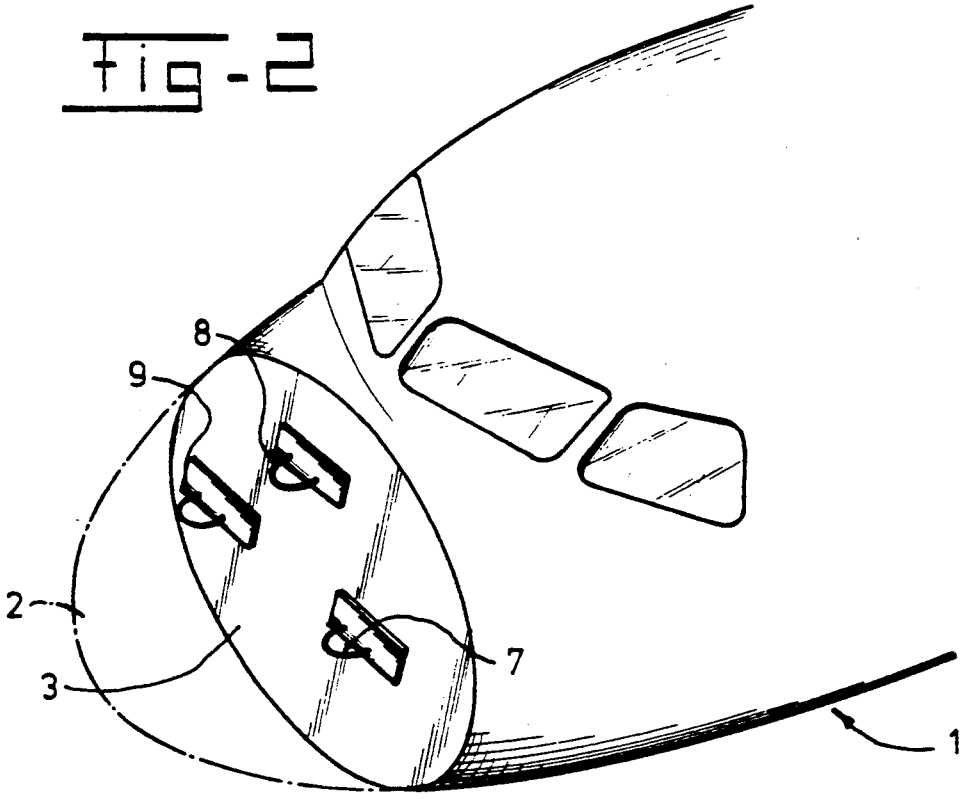
FIG. 2 shows the same configuration, but now each aerial has its own base plate which is constructed as a vertical plate parallel to the ground plane at a distance of approximately $\frac{1}{4}\lambda$ therefrom and supported in the centre on the rear side. The length (horizontal dimension) is approximately equal to $\frac{1}{2}\lambda$, while the width (dimension in the height direction) is approximately one and a half to two times as large as the loop diameter of the aerial.

FIGS. 3(*a*) and 3(*b*) two views of an aerial baseplate mounting structure designed to be used in the system of FIG. 2. Each aerial comprises the semicircular arc-type aerial which is mounted on the base plate 11. The aerial of these component 10 is shown only diagrammatically. The diameter of the circular arc of the aerial component is indicated by a. It is pointed out that said aerial does not need to be of the semicircular arc type and that the connection between the aerial component 10 and the base plate 11 is not a direct connection in all cases either, but that use may be made of coupling elements, connecting strips, connector parts etc. However, all these details which in fact are part of the aerial itself details are not of importance in relation to the invention and will therefore not be discussed in more detail. Reference is made to the literature for actual embodiments of such an aerial.

The base plate 11 is of a length L which is approximately equal to $\frac{1}{2}\lambda$ ($\lambda$ being the wavelength at which the aerial 10 functions) and a width B, which has preferably to exceed a. Mounted in the centre of the base plate 11 is a supporting component, in this simple exemplary embodiment composed of a tube 12 and a mounting plate 13 in which a number of holes is provided through which bolts can be inserted. Through the inside of the tube, a coaxial cable can be led to the input connector of the aerial. In this way, the coaxial cable has no effect of the impedance and radiation characteristics of the aerial. The dimensioning of the parts 12 and 13 is such that, after mounting the aerial against the front pressure bulkhead of the aircraft 1, the base plate, 11 is situated at a distance h equal to approximately $\frac{1}{4}\lambda$ or less above the front pressure bulkhead 3.

The separate base plate 11 for each of the aerials 7, 8 and 9 ensures a decoupling of the aerials with respect to the pressure bulkhead, with the result that the mutual coupling between the diverse aerials is appreciably reduced.

FIG. 4 illustrates diagrammatically the "shadow effect" which originates from the base plate. In FIG. 4, the aerial is again indicated by 10, the base plate by 11 and the ground plane by 14. The base plate 11 is mounted by means of the support 12 and the mounting plate 13 on the ground plane 14. In FIG. 4, a part of the fuselage of the aircraft is furthermore indicated visibly by 15. The "line of sight" 16 indicates that part 15 is not visible from the aerial component 10.

It is evident from FIG. 4 that, with suitable positioning, the projecting farthest part of the aerial is not capable of "seeing" the edge of the radome space, indicated by 15 in FIG. 4. In other words, when positioned as shown, the base plate ensures that the edge of the radome space remains in the "shadow". This achieves the result that the base plate also functions as a screening plate. In a practical embodiment, the shadow line runs at an angle of $\alpha=38°$, while the sight angle from the edge 15 to the edge of the base plate 11 (line 17 in FIG. 4) extends at an angle of 54°. In other words, the edge of the radome is in the shadow. A reduced irradiation of the edge 15 will also occur if the edge 15 can in fact be seen by a section of the aerial.

Figure 5A:
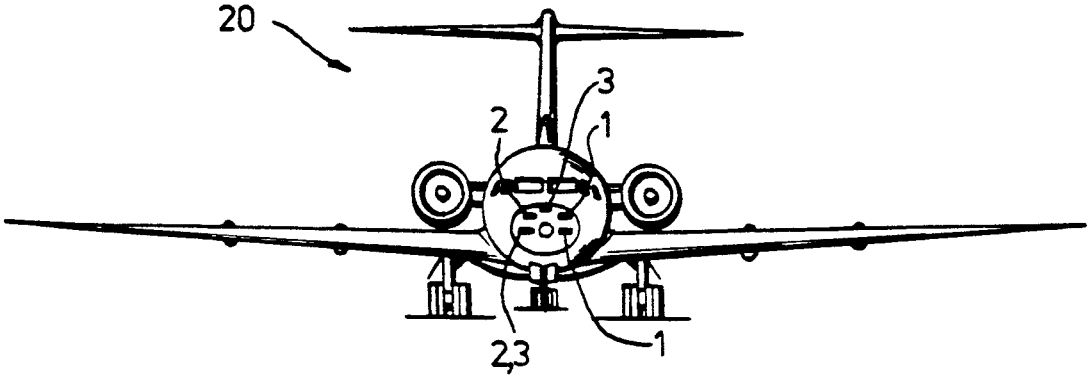
FIG. 5*a–b* shows a front view of a practical embodiment of three glide-slope aerials combined with further aerial components on the front bulkhead of an aircraft.
Figure 5B:
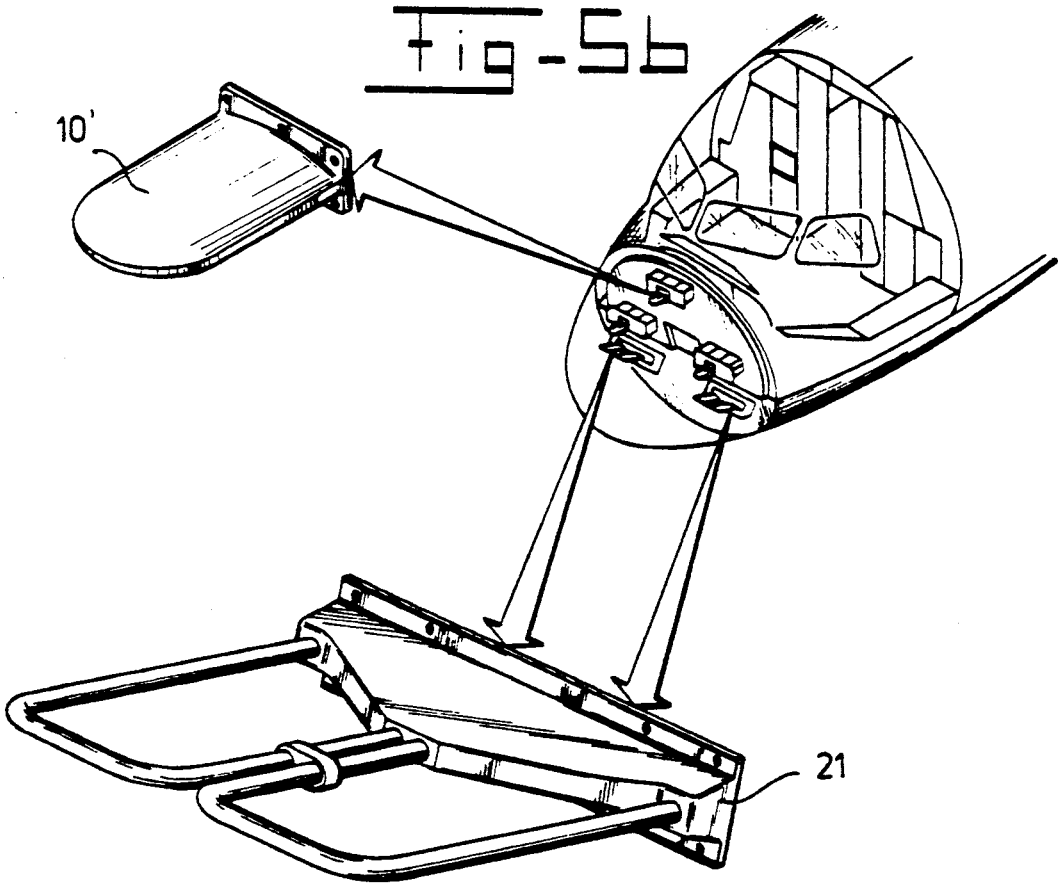

FIGS. 5*a* and 5*b* show views which make clear how the glide-slope aerials according to the invention are positioned in the radome space of an aircraft. FIG. 5*a* shows the front view of an aircraft with the radome fairing removed to reveal the diverse aerials of the instrument landing system. FIG. 5*b* shows in a partial view more detail of the positioning of the diverse aerials in perspective.

In FIG. 5*a*, the aircraft is indicated as a whole by 20. Said aircraft is provided with an instrument landing system incorporating five aerials which are fitted inside the radome space in the nose of the aircraft. More particularly, these are three glide-slope aerials, indicated in FIG. 5*a* by glide slope 1, glide slope 2 and glide slope 3, which aerials serve to detect glide slope signals during the descent of the aircraft. Furthermore, the instrument landing system is provided with two so-called localizer aerials, indicated by localizer 1 and a combined aerial indicated by localizer 2, 3, which aerials are used to determine the direction during the descent flight. For the sake of completeness, FIG. 5*a* also indicates where the weather radar, indicated by "weather radar", is situated in this positioning scheme.

FIG. 5*b* again illustrates the position of the diverse aerials in perspective, the aircraft itself being shown in a more or less general way. One of the glide-slope aerial components is indicated separately by the reference numeral 10′. The whole component is encapsulated in a casing and is sited on the base plate with the aid of said casing. The base plates, which are not provided with separate reference numerals in FIG. 5*b*, are mounted by means of a supporting structure against the front pressure bulkhead of the radome space. The localizer aerial 21, which is also shown in detail, does not furthermore form part of the invention and does not require a more detailed discussion.

We claim:

1. A glide-slope aerial system intended to function in a relatively restricted space, said system comprising at least one semi-circular, arc-type or half-loop aerial which is supported on an electrically conducting ground plane within said restricted space wherein each said aerial is mounted on a separate base plate positioned, configured and dimensioned to resonate at the frequency at which the respective aerial operates, the base plate being positioned in said restricted space approximately parallel to the ground plane, the distance between the base plate and the ground plane being approximately equal to $\frac{1}{4}$ of the wavelength at which the respective aerial functions, and wherein said aerial system comprises the essentially semicircular arc-type aerial sited on the base plate at a position where a plane through the semi-circular arc-type aerial is perpendicular to the base plate, the length of the base plate measured in the direction of a line of intersection defined by two planes formed by said plane through the aerial and a plane of said base plate, being approximately equal to a half wavelength, while the width of the base plate measured in a direction perpendicular to said line of intersection of said two planes is preferably at least equal to the diameter of the semicircular arc-type aerial component.

2. A glide-slope aerial system according to claim 1, wherein the base plate is provided with suitable mounting means with which the base plate can be mounted at a distance of approximately a $\frac{1}{4}$ wavelength above said ground plane.

3. A glide-slope aerial system according to claim 1, wherein the base plate is positioned with respect to the ground plane of said space in a manner such that the edge of said ground plane is situated substantially in the shadow of the base plate as seen from a farthest projecting part of said aerial mounted on said base plate.

4. A glide-slope aerial system intended to function in a relatively restricted space, said restricted space being of the type which is at one side confined by an electrically conducting ground plane, which aerial system includes at least one half-loop aerial for transmitting and receiving radio signals at predetermined frequencies, said aerial comprising an essentially semicircular arc-type aerial component and a base plate, the aerial component being mounted on said base plate in a manner such that the plane through the semicircular arc-type aerial component is perpendicular to the plane of the base plate, said base plate being resonant at its respective predetermined frequency by selecting the length of the base plate measured in the direction of the line of intersection of two planes to, defined by said plane through the aerial component and said plane of the base plate, to be approximately equal to a half-wavelength, wherein the width of the base plate measured in a direction perpendicular to said line of intersection of said two planes is at least equal to the diameter of said semicircular arc-type aerial component, and wherein the base plate is positioned with respect to the ground plane of said space in such a manner that the edge of the ground plane is situated substantially completely in the shadow of the base plate as seen from the farthest projecting part of the aerial component mounted on said base plate.

* * * * *